US012215557B2

(12) United States Patent
Alleman et al.

(10) Patent No.: US 12,215,557 B2
(45) Date of Patent: Feb. 4, 2025

(54) METHOD AND APPARATUS TO RECOVER CORES FROM DOWNHOLE ENVIRONMENTS

(71) Applicant: Professional Coring Enterprises, LLC, Conroe, TX (US)

(72) Inventors: Jamie Mark Alleman, Willis, TX (US); Karen L. O'Neal, Willow City, TX (US); William Harold Scott, III, New Waverly, TX (US)

(73) Assignee: PROFESSIONAL CORING ENTERPRISES, LLC, Conroe, TX (US)

( * ) Notice: Subject to any disclaimer, the term of this patent is extended or adjusted under 35 U.S.C. 154(b) by 37 days.

(21) Appl. No.: 18/096,405

(22) Filed: Jan. 12, 2023

(65) Prior Publication Data

US 2023/0167701 A1 Jun. 1, 2023

Related U.S. Application Data

(63) Continuation-in-part of application No. 17/166,472, filed on Feb. 3, 2021, now abandoned.

(60) Provisional application No. 62/970,909, filed on Feb. 6, 2020.

(51) Int. Cl.

| | |
|---|---|
| ***E21B 25/00*** | (2006.01) |
| ***E21B 47/06*** | (2012.01) |
| ***E21B 47/12*** | (2012.01) |

(52) U.S. Cl.

CPC ..... *E21B 25/00* (2013.01); *E21B 47/06* (2013.01); *E21B 47/12* (2013.01)

(58) Field of Classification Search

CPC ..... E21B 25/00; E21B 47/12; E21B 47/06; E21B 47/01; E21B 47/00; E21B 44/00

See application file for complete search history.

(56) References Cited

U.S. PATENT DOCUMENTS 6,000,844 A * 12/1999 Cramer ..... G01N 25/72 374/7

2021/0246747 A1* 8/2021 Alleman ..... E21B 21/10

* cited by examiner

*Primary Examiner* — Caroline N Butcher

(74) *Attorney, Agent, or Firm* — Ewing & Jones, PLLC

(57) ABSTRACT

Methods relate to recovering cores from downhole environments where downhole environmental parameters are measured during coring operations.

18 Claims, 5 Drawing Sheets

METHOD AND APPARATUS TO RECOVER CORES FROM DOWNHOLE ENVIRONMENTS

CROSS-REFERENCE TO RELATED APPLICATIONS

The present continuation-in-part application claims priority to U.S. application Ser. No. 17/166,472, filed Feb. 3, 2021 which in turn claims priority to U.S. Provisional Application 62/970,909, filed Feb. 6, 2020 the entirety of which is incorporated by reference.

FIELD OF THE DISCLOSURE

Aspects of the disclosure relate to recovery of cores samples from Earth's geological strata. More specifically, aspects of the disclosure relate to methods and apparatus to successfully recover valuable geological cores samples from downhole environments.

BACKGROUND INFORMATION

Obtaining cores from Earth's geological stratum is an important function in the recovery of hydrocarbons. In conventional wells, cores can be obtained through drilling at a bottom of the wellbore or coring through a side wall of the wellbore. Each of these methods has distinct issues/problems that must be overcome, in order to retrieve a successful core. Often times, geologists require numerous cores to be obtained from specific stratum in order to ascertain the amount of hydrocarbon bearing material that may be recovered.

As these cores are difficult to obtain, the cores are extremely valuable in ascertaining the viability of a hydrocarbon field. If, for example, a core is obtained that indicates that hydrocarbons are not present, a potential developer may forgo drilling, thereby saving millions of dollars in capital expenditures on a potential project that has little or no potential capital return. In other instances, for example, the presence of hydrocarbons in specific stratum may indicate that numerous wells can be drilled into the stratum to recover the trapped hydrocarbon reserves. Such a find would indicate that additional capital expenditure is warranted under the known conditions.

When coring at the bottom of a wellbore, it can be difficult to obtain the cores because the cores have a tendency to break. This breakage can lead to the core jamming within the coring apparatus, thereby preventing the desired amount of core from being obtained. In coring at the bottom of the wellbore, conventional operations dictate that operators merely lower a coring apparatus into place to attempt to successfully obtain a core.

When conventional wells are drilled, more specifically, when directional wells are drilled, often a measurements while drilling (MWD) device is used to steer the well. An MWD is located within the drill pipe and above the drill bit and typically takes measurements such as inclination, azimuth, temperature, shock, vibration, and gamma radiation. These measurements are transmitted from the MWD device to the surface so that an operator can make real time decisions having to do with drilling the well. Most commonly, an MWD device transmits data to the surface through pressure pulses within the drilling fluid or by electromagnetic signals through the Earth's strata, both often referred to in the art as "mud pulse telemetry" and "EM telemetry" respectively. In conventional apparatus, the MWD is incorporated and inseparable from the coring device. No independent movement is allowed.

There is a need to provide apparatus and methods that are easier to perform by field personnel compared to conventional apparatus and methods.

There is a further need to provide apparatus and methods that do not have the drawbacks discussed above, and that will provide cores that are unbroken.

There is a still further need to reduce economic costs associated with conventional operations and apparatus described above with conventional tools to allow geologists the ability to ascertain the presence of hydrocarbons without unnecessary down time due to broken or jammed cores. There is a further need to provide independence of movement between an MWD and a coring device such that the MWD may be moved independently from the coring device.

SUMMARY

So that the manner in which the above recited features of the present disclosure can be understood in detail, a more particular description of the disclosure, briefly summarized below, may be had by reference to embodiments, some of which are illustrated in the drawings. It is to be noted that the drawings illustrate only typical embodiments of this disclosure, and are therefore not to be considered limiting of its scope, for the disclosure may admit to other equally effective embodiments without specific recitation. Accordingly, the following summary provides just a few aspects of the description and should not be used to limit the described embodiments to a single concept.

In one embodiment, a method for recovering a core from a downhole environment is disclosed. The method may comprise providing a measurements while coring device and a coring apparatus within a wellbore, the measurements while coring device separately retrievable from the wellbore from the coring apparatus, and lowering the measurements while coring device and the coring apparatus to an elevation where a core is to be obtained. The method may also provide for positioning the coring apparatus to the bottom of a wellbore and starting the coring apparatus. The method may also comprise conducting coring operations. The method may also comprise taking at least one measurement with the measurements while coring device in an inner tube within the coring apparatus during coring operations.

In another example embodiment, a coring apparatus is disclosed. The coring apparatus described is an assembly for retrieving a core from the bottom of a wellbore. The coring apparatus may comprise a hollow coring bit which is lowered to the bottom of the wellbore and rotated to recover a core through a center circular opening within the coring bit. The coring apparatus may also comprise an outer tube positioned above the coring bit wherein the outer tube transmits rotational energy from surface to the coring bit. The coring apparatus may also comprise an inner tube positioned within the outer tube where the inner tube separates the high-pressure drilling fluid from the core being drilled as well as receive the core as the wellbore is drilled deeper around the core. The coring apparatus may also comprise a swivel assembly positioned inside the outer tube and connected to the inner tube where the swivel assembly allows the inner tube to be stationary relative to the rotational motion of the outer tube. The coring apparatus may also comprise a top sub positioned above and connected to the outer tube and swivel assembly wherein the top sub transmits rotational energy from the surface to the outer tube. The coring apparatus may also comprise a top sub positioned below and connected to a string of drill pipe extending to the surface where rotational energy is transferred from a drilling rig on surface through the string of drill pipe to the top sub further transmitting rotational energy to the outer tube and finally the coring bit.

In another example embodiment, a method for recovering a core from a downhole environment is disclosed. The method may comprise providing a measurements while coring device and a coring apparatus within a wellbore and lowering the measurements while coring device and the coring apparatus to an elevation where a core is to be obtained. The method may also provide for positioning the coring apparatus to the elevation in the wellbore where a core is to be obtained and starting the coring apparatus. The method may further comprise conducting coring operations. The method may also comprise taking a pressure measurement within an inner tube of the coring apparatus with the measurements while coring device and transmitting the pressure measurement to the surface.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted, however, that the appended drawings illustrate only typical embodiments of this disclosure, and are therefore not to be considered limiting of its scope, for the disclosure may admit to other equally effective embodiments.

Figure 1:
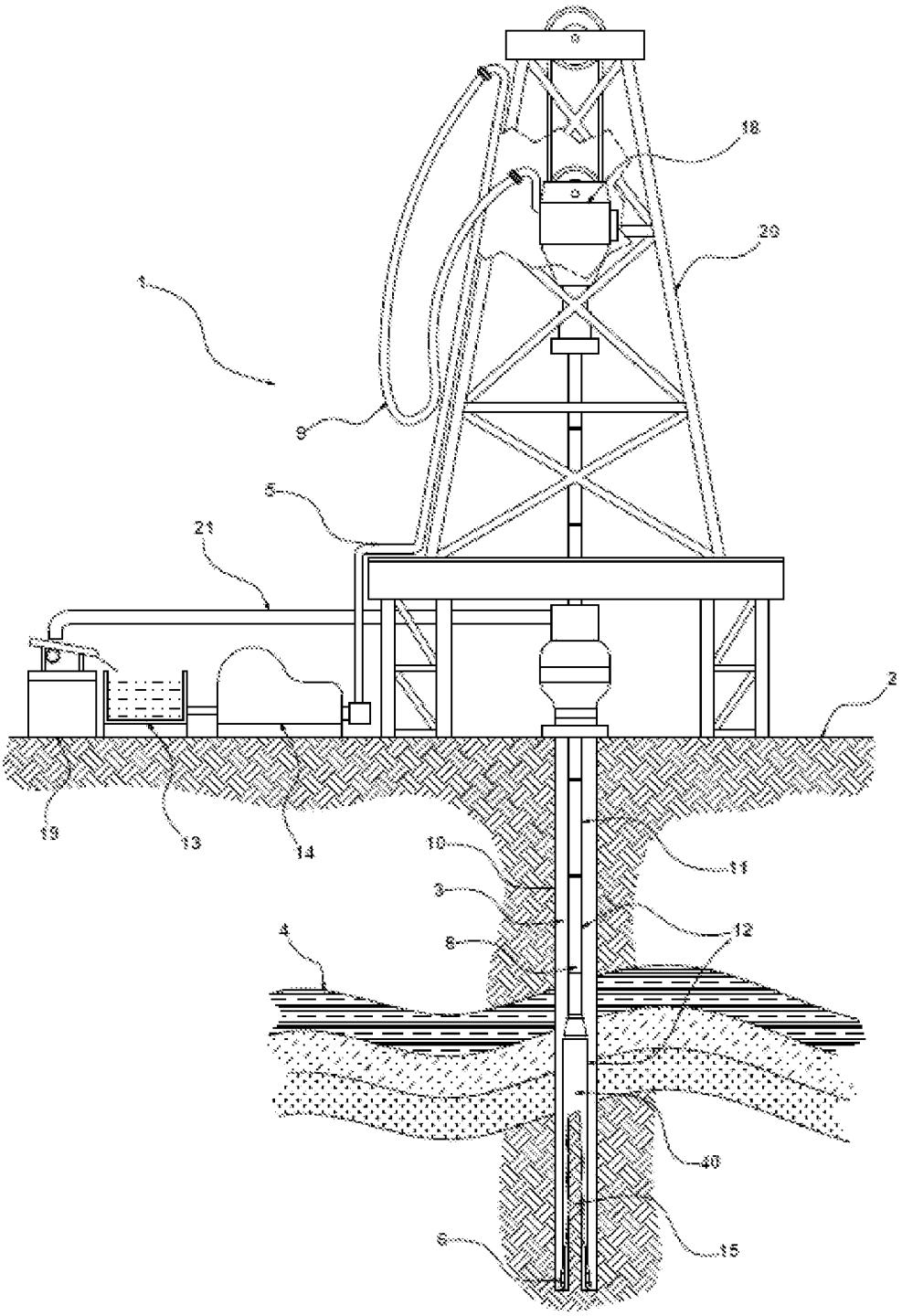
FIG. 1 is a drill rig performing a hydrocarbon recovery operation in one aspect of the disclosure.

To facilitate understanding, identical reference numerals have been used, where possible, to designate identical elements that are common to the figures ("FIGS"). It is contemplated that elements disclosed in one embodiment may be beneficially utilized on other embodiments without specific recitation.

DETAILED DESCRIPTION

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments and advantages are merely illustrative and are not considered elements or limitations of the claims except where explicitly recited in a claim. Likewise, reference to "the disclosure" shall not be construed as a generalization of inventive subject matter disclosed herein and shall not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second" and other numerical terms, when used herein, do not imply a sequence or order unless clearly indicated by the context. Thus, a first element, component, region, layer or section discussed herein could be termed a second element, component, region, layer or section without departing from the teachings of the example embodiments.

When an element or layer is referred to as being "on," "engaged to," "connected to," or "coupled to" another element or layer, it may be directly on, engaged, connected, coupled to the other element or layer, or interleaving elements or layers may be present. In contrast, when an element is referred to as being "directly on," "directly engaged to," "directly connected to," or "directly coupled to" another element or layer, there may be no interleaving elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

Referring to FIG. 1, a drilling rig 1 is illustrated. The purpose of the drilling rig 1 is to drill into Earth's geological strata for the purpose of obtaining hydrocarbons from beneath the surface 2. Different stratum 4 may be encountered during the creation of a wellbore 10. In FIG. 1, as will be understood, multiple layers of stratum 4 may be encountered. Stratum 4 may be varied in composition, and may include rock, sand, clay and silt and/or combinations of these. Operators, therefore, need to assess the composition of the stratum 4 in order to ascertain a maximum penetration depth used in the drilling process. The wellbore 10 is formed within the stratum 4 by a drill bit 6. In embodiments, the drill bit 6 is rotated such that contact between the drill bit 6 and the stratum 4 cuts the stratum 4 at the bottom of the wellbore 10. Differing types of drill bits 6 may be used to penetrate different types of stratum 4. The types of stratum 4 encountered, therefore, is an important characteristic for operators. The types of drill bits 6 may vary widely. Non-limiting embodiments of drill bits 6 may include polycrystalline diamond compact ("PDC") drill bits, roller cone bits, diamond impregnated, and hammer bits.

As the wellbore 10 progresses in depth, operators may add portions of drill pipe 11 to form a drill string 12 that extends from the surface to the bottom of the wellbore 10. As illustrated in FIG. 1, the drill string 12 may vertically extend into the stratum 4. In other embodiments, the drill string 12 and the wellbore 10 may deviate from a vertical orientation, such as having sections that are inclined from the vertical.

The drill bit 6 is larger in diameter than the drill string 12 such that when the drill bit 6 produces the wellbore 10, an annular space 3 is created between the drill string 12 and the inside face of the wellbore 10. This annular space 3 may be used during the drilling process to remove cuttings from the wellbore 10. The removal of cuttings may be accomplished by flushing drilling fluids down the drill string 12, through the drill bit 6, and then up the annular space 3 between the drill string 12 and the wellbore 10. Drilling fluids include water and specialty chemicals to aid in the formation of the wellbore 10.

The drilling fluids is stored in a tank 13 located at the drill site. A pump 14 pressurizes and transfers the drilling fluid to the drilling rig 1 by means of a series of pipes 5 and a high-pressure flexible hose 9. The high-pressure flexible hose 9 is attached to a top drive device 18 which hangs from the derrick 20 and controls the position of and rotates the drill sting 12. The drilling fluid progresses from the top drive device 18 through the drill string 12 and down to the drill bit 6. The drilling fluid helps the drill bit 6 cut the strata and then travels up the annular space 3. As the drilling fluid travels up the annular space 3 it carries the cut strata 4 to the surface 2. The drilling fluid makes it way from the annular space 3 to a shaker device 19 by means of a recirculating tube 21. The shaker device 19 processes and removes solids from the drilling fluid and transfers it back to the tank 14. Although the drill string 12 is illustrated as being rotated by a top drive device 18, other configurations are possible.

During the process of the wellbore 10 being drilled, operators may desire to obtain a core from the wellbore 10 at specific points. In the aspects disclosed, a drill string 12 is placed within the wellbore 10. The drill string 12 has an MWD device 8 within the drill pipe that is taking measurements of wellbore 10 characteristics during a coring of the wellbore 10. A coring apparatus 40 is also conveyed in the wellbore 10 and connected below the drill pipe 11 to provide the capability of obtaining a core.

In the current embodiment, the core 15 is to be taken from the bottom of the wellbore 10. During operations, an MWD device 8 is configured to take data from the environment within the coring apparatus 40 and transmit the data to the operator on the surface 2, as seen in FIG. 1. A non-limiting example of data obtained by the MWD device 8 is inner tube pressure, drill pipe pressure, temperature, shock, revolutions per minute, vibration and gamma.

Figure 2:
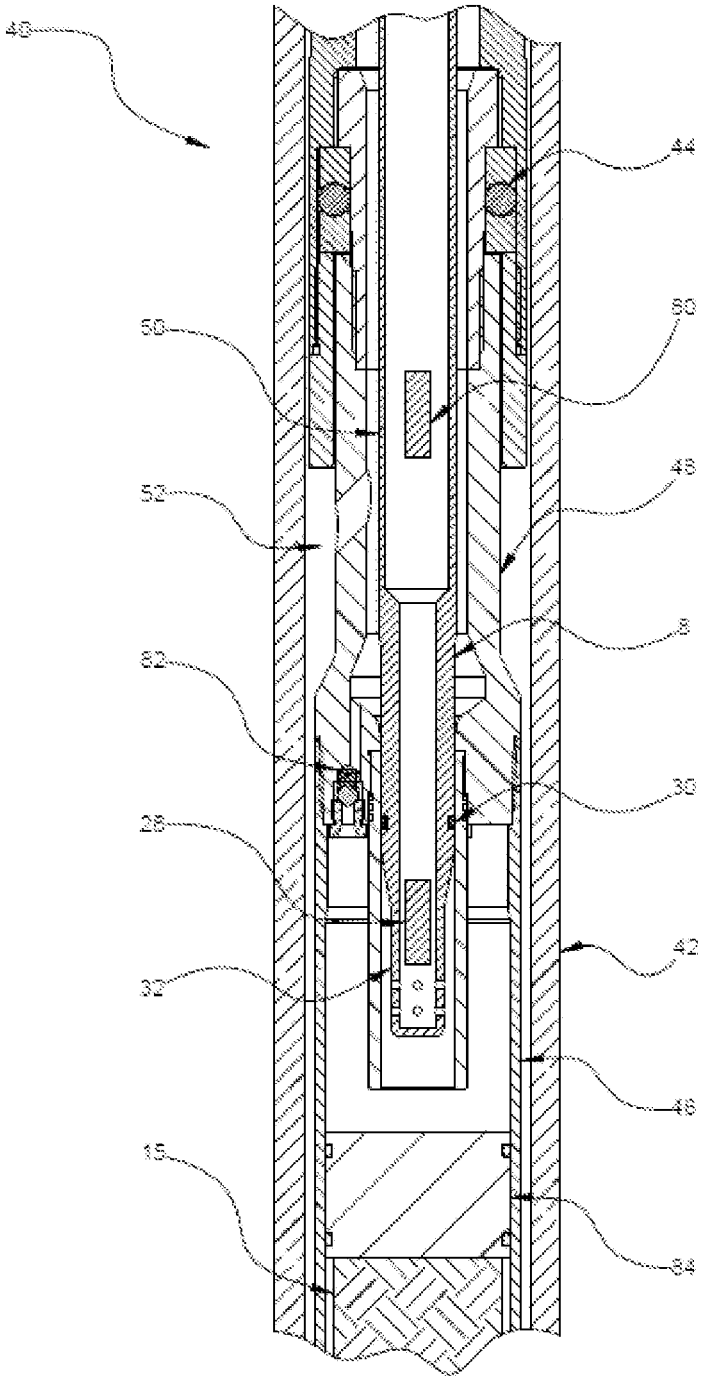
FIG. 2 is a side cross-sectional view of an MWD device and a coring apparatus in accordance with one example embodiment of the disclosure.

Referring to FIG. 2, a cross sectional view of a coring apparatus 40 and an MWD device 8 is illustrated. The coring apparatus 40 is configured with an outer tube 42 that extends along the length of the coring apparatus 40. A bearing assembly 44 is provided so that the outer tube 42 may freely rotate around an inner tube 46 and the core 15 being drilled. The inner tube 46 is connected to a bearing assembly 44 by means of a flow diverter 48. Drilling fluid that is passing within a space 50 between the inside of the coring apparatus 40 and the outside of the MWD device 8 is transferred to a space 52 between the outer tube 42 and the inner tube 46 by the flow diverter 48. The bottom of the MWD device 8 protrudes through a center opening in the flow diverter 48 to the empty space within the inner tube 46.

As the core 15 is drilled, the inner tube 46 accepts the core 15 and protects the core 15 from the high pressure drilling fluid. As the coring bit 6 bores deeper, the core 15 rises upwards within the inner tube 46. The bearing assembly 44 allows the inner tube 46 to be stationary relative to the core 15 so that rotational motion of the outer tube 42 does not break the core 15 which can result in the core 15 jamming within the inner tube 46.

Changing Inner tube 46 pressure may be sensed by a pressure sensor 28 within the MWD device 8. Data from the pressure sensor 28 may be sent to an operator on surface 2 by the MWD device 8.

In order to maintain pressures differences between the inner tube 46 and outer tube 42, a seal 30 is provided between the MWD device 8 and the center opening of the flow diverter 48. The seal 30 allows for any axial or rotational motion between the flow diverter 48 and the MWD device 8.

The MWD device 8 is configured to provide real time data to an operator on surface 2 to allow the operator to understand the current down hole conditions at the bottom of the wellbore 10. Degraded operations due to downhole characteristics being out of specification are avoided, however, with the aspects described. The MWD device 8 is configured to measure different characteristics of pressure, shock, revolutions per minute, vibration, and gamma as non-limiting embodiments. The operator can use the real time data to minimize costly down time due to cores breaking and or jamming within the inner tube 46.

In embodiments, an arrangement 80 is provided to monitor the revolutions per unit time between the outer tube 42 and the inner tube 46. To this end, embodiments provide for a sensor configured to measure revolutions per minute. This arrangement 80 may be located in the measurement while drilling part of the coring apparatus 40.

In embodiments, pressure relief valves 82 are provided to allow for pressure to be removed within the inner tube 46. As will be understood, at least one pressure relief valve 82 is provided. Other configurations provide for more than one valve. As will be understood, at least three pressure relief assemblies are provided. Conventional systems do not provide for this configuration or capability.

In embodiments, the build-up of pressure in the empty space 86 within the inner tube 46 may be released into the pumped drilling fluid within the empty space 50 of the flow diverter.

In further embodiments, a pressure sealed plug 84 is provided. The pressure sealed plug 84 is placed in the empty space 86 within the inner tube 46. As the inner tube 46 moves over the core 15, the pressure plug 83 is in contact with the top of the core 15 and allowed to move freely through the inner tube 46 as it is pushed by the core 15. The movement of the pressure sealed plug 84 increases the pressure with the inner tube 46 to a point greater than the pumped drilling fluid within the empty space 50 of the flow diverter 48 until the pressure relief valves 82 actuate.

Figure 3:
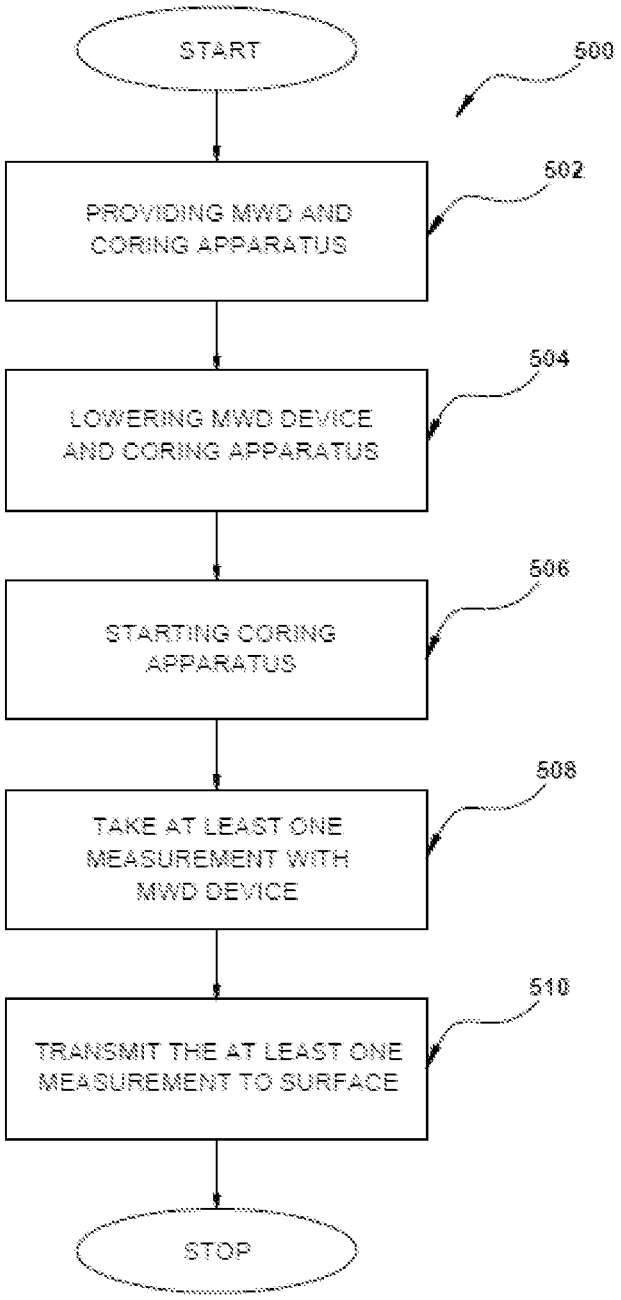
FIG. 3 is a method of taking a core in accordance with one example embodiment of the disclosure.

Referring to FIG. 3, a method 500 for recovering a core 15 from a downhole environment is illustrated. The method includes, at 502, providing an measure while coring or an MWD device 8 and a coring apparatus 40 within a wellbore 10. The method further includes, at 504, lowering the measure while coring or MWD device 8 and coring apparatus 40 to a selected position in the wellbore 10 where a core is desired to be obtained. The method 500 also includes, at 506, starting the coring apparatus 40. At 508, the method progresses to conducting coring operations. At 510, the method progresses with taking at least one measurement with the measure while coring or MWD device 8 within the coring apparatus 40 during an operational period of the coring apparatus 40. At 510, the method progresses with the MWD or measure while coring device 8 transmitting the at least one measurement to the operator on the surface 2. As will be understood, during core recovery operations, a measurement may be taken by the measure while coring or MWD device 8 and compared to a threshold value. In embodiments, the threshold value may be a pressure measurement limit, a shock measurement limit, revolutions per minute, a vibration measurement limit and a gamma measurement limit. During that time, if measured values exceed a threshold value, coring operations may be terminated. Such termination may be automatic or a signal may be sent to an operator at the surface 2, notifying the operator of an exceeded value.

As will be understood, the taking of the at least one measurement may be accomplished within the coring apparatus 40 by the measure while coring or MWD device 8. A step of transmitting the data from the taking of the at least one measurement to the surface 2 may be accomplished. Transmission of the data to the surface 2 from the measure while coring or MWD device 8 may be done through mud pulse telemetry or EM telemetry as non-limiting embodiments. The measurement may be obtained within an inner tube area of the coring apparatus, as described above. Aspects of the disclosure provide for the device 8 to be moved independently from the remainder of the coring apparatus 40, not seen by conventional apparatus.

Figure 4:
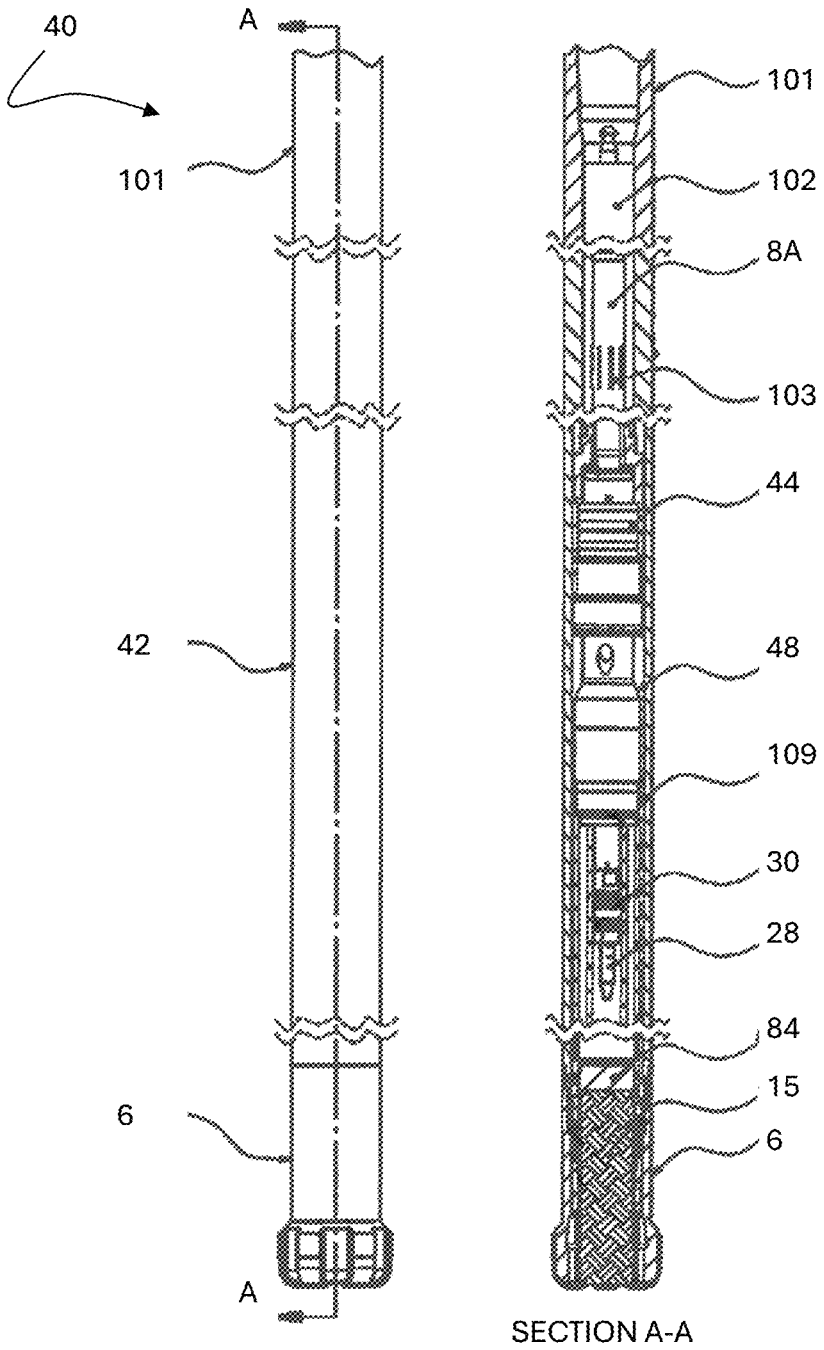
FIG. 4 is a side view of an example embodiment of the disclosure.
Figure 5:
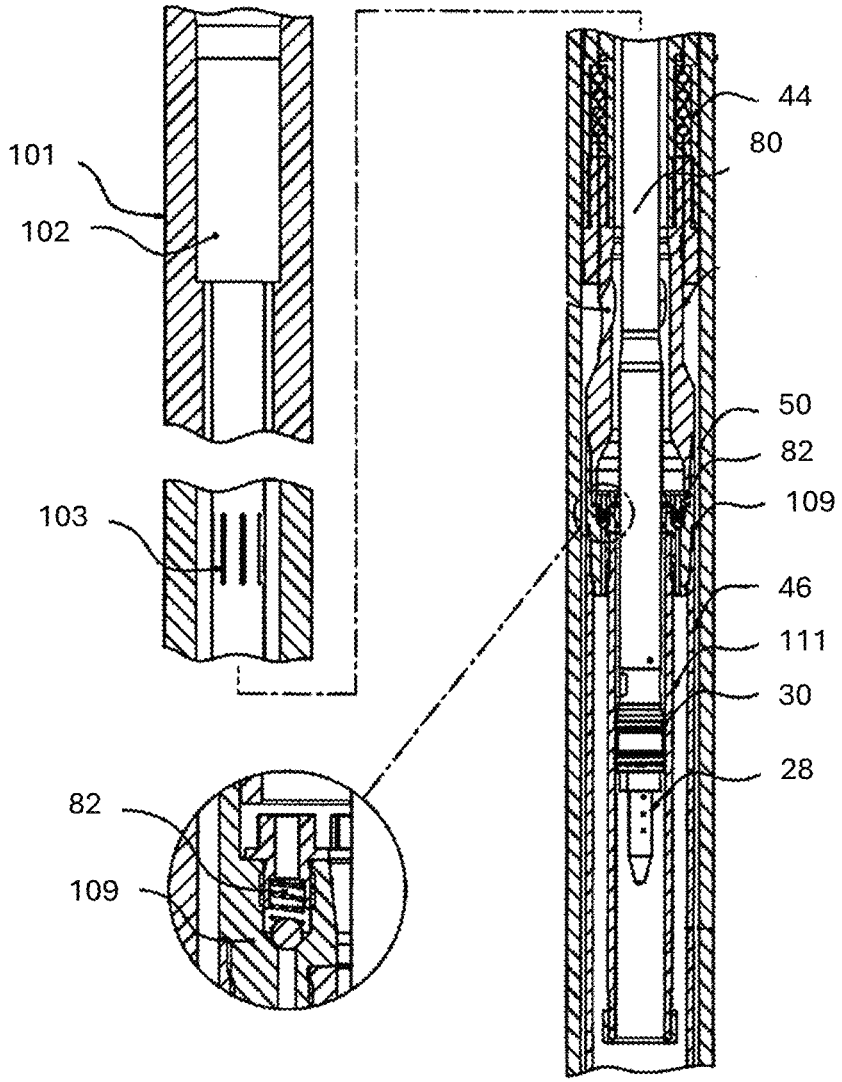
FIG. 5 is a cross-sectional view of an example embodiment of the disclosure.

Referring to FIG. 4, a side view of one example embodiment of the disclosure is presented. An arrangement 101, hereinafter UBHO, is illustrated at one end of an example embodiment of the disclosure. A pulser 102 is located within the arrangement 101 to create a pulsing action within the arrangement 101. The pulser 102 acts in consort with a measurement while coring device 8A, that is located within the tool. Unlike conventional apparatus, the measurement while coring device 8A make take various measurements of the downhole environment and then transmit that data, through the pulser 102 to the uphole environment. In embodiments, the measurement while coring device 8A may be independently retrievable from the remainder of the tool. A dynamic rotating seal 30 is provided that allows for sealing of internal components during operations. The dynamic rotating seal 30 provides superior sealing compared to diverter ball applications of conventional applications. For example, diverter ball systems use a ball like structure to divert materials, such as fluids from a first channel to a second channel, thus sealing a portion of the structure in certain cases. The dynamic rotation seal, however, allows for sealing capabilities of a relief valve housing 109. Flow pressure within the tool may be measured, in embodiments, through a flow pressure sensor 103 located upstream of a bearing assembly 44 positioned to allow rotation, as needed, within portions of the tool. A separate flow diverter 48 is positioned within the tool for controlling flow of fluid. The flow diverter may be actuated, as necessary, by operators, thereby changing modes of operation of components within the tool. Referring to FIG. 5, an expanded view of FIG. 4 is illustrated. The relief valve housing 109 is illustrated in greater detail. A pressure relief valve 82 is located to allow pressure to be maintained up to a preset limit. The relief valve 82 may have a spring to allow for pressing the ball into a ball seat, thereby closing the pressure relief valve 82. Such a pressure relief valve 82 is not found in conventional apparatus. In one embodiment, the flow pressure sensor 103 may be a component within the remainder of the tool, apart from the retrievable measurement while coring device. In this embodiment, the pressure sensor 28 may be isolated from other sections of the tool through the use of the dynamic rotating seal 30. The seal 30 is located within the seal assembly housing 111.

In one embodiment, a method for recovering a core from a downhole environment is disclosed. The method may include providing a measurements while drilling device and a coring apparatus within a wellbore. The method may also include positioning the coring apparatus and measurements while drilling device to an elevation of the wellbore where a core is to be taken and starting the coring apparatus. The method may also include starting coring operations. The method may also include taking at least one measurement in an inner tube of the coring apparatus during the coring operations.

In another embodiment, the method may further comprise a measurements while drilling device transmitting the at least one measurement to the surface where an operator can analyze the at least one measurement.

In another embodiment, the method may further comprise stopping the coring apparatus when the at least one measurement exceeds a threshold.

In another embodiment, the method may be performed wherein the at least one measurement is a pressure measurement.

In another embodiment, the method may be performed wherein the at least one measurement is a shock measurement.

In another embodiment, the method may be performed wherein the at least one measurement is a vibration measurement.

In another embodiment, the method may be performed wherein the at least one measurement is a gamma measurement.

In another embodiment, the method may be performed wherein the at least one measurement is a revolutions per time measurement.

In another example embodiment, the coring apparatus may comprise an outer tube and an inner tube placed within the outer tube. The coring apparatus may further comprise a bearing assembly configured to allow rotation of the outer tube around the inner tube. The coring apparatus may also comprise at least one arrangement wherein a measurements while drilling device positioned within the coring apparatus is configured to take at least one measurement during coring operations.

In another example, the measurements while drilling device may be configured wherein at least one arrangement is a pressure sensor configured to read a pressure within the coring apparatus.

In another example embodiment, the coring apparatus may be configured wherein the measurements while drilling device is configured to transmit data to a surface environment.

In another example embodiment, a method for recovering a core from a downhole environment is disclosed. The method may include providing a measurements while drilling device and a coring apparatus within a wellbore. The method may also include positioning the coring apparatus and measurements while drilling device to the bottom of the wellbore and starting the coring apparatus. The method may also provide for taking a pressure measurement within an inner tube of the coring apparatus during coring operations and transmitting the pressure measurement to an operator at a surface elevation.

In another example embodiment, the method may be performed wherein the taking of the at least one measurement within the inner tube of the coring apparatus during coring operations is with a sensor within the measurements while drilling device.

In another example embodiment, the method may be performed wherein the pressure measurement is made above the core within the inner tube.

In another example embodiment, the method may be performed wherein the pressure measurement is analyzed on surface by an operator.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may be varied in many ways. Such variations are not to be regarded as a departure from the disclosure, and all such modifications are intended to be included within the scope of the disclosure.

While embodiments have been described herein, those skilled in the art, having benefit of this disclosure, will appreciate that other embodiments are envisioned that do not depart from the inventive scope. Accordingly, the scope of the present claims or any subsequent claims shall not be unduly limited by the description of the embodiments described herein.

What is claimed is:

1. A method for recovering a core from a downhole environment, comprising:

providing a measure while coring device and a coring apparatus within a wellbore, wherein the coring apparatus includes an inner tube configured to receive the core, a pressure sealed plug within the inner tube and a pressure relief valve actuatable to relieve pressure within the inner tube;

lowering the measure while coring device and the coring apparatus to an elevation where the core is to be obtained;

positioning the coring apparatus at the elevation where the core is to be obtained;

starting the coring apparatus;

conducting coring operations thereby causing the core to push the pressure sealed plug through the inner tube increasing pressure within the inner tube until the pressure relief valve actuates; and taking at least one measurement in the inner tube of the coring apparatus during the coring operations.

2. The method according to claim 1, further comprising:

transmitting the at least one measurement to an operator at the surface.

3. The method according to claim 2, further comprising:

comparing the at least one measurement to a threshold value.

4. The method according to claim 2, wherein the at least one measurement is one of a pressure measurement, a shock measurement, a revolutions per unit time, a vibration measurement and a gamma measurement.

5. The method according to claim 3, further comprising:

stopping the coring apparatus when the at least one measurement exceeds the threshold value.

6. The method according to claim 3, wherein the threshold value is at least one of a pressure measurement limit, a shock measurement limit, a revolution per unit time, a vibration measurement limit and a gamma measurement limit.

7. The method according to claim 5, wherein stopping the coring apparatus when the at least one measurement exceeds the threshold includes transmitting the at least one measurement from a downhole environment to an up-hole environment.

8. The method according to claim 1, wherein the measure while coring device is separately retrievable from the wellbore from the coring apparatus.

9. The method according to claim 1, wherein the pressure relief valve includes a spring pressing a ball into a ball seat, thereby selectively closing the pressure relief valve up to a preset pressure limit within the inner tube.

10. A method for recovering a core from a downhole environment, comprising:

providing a measure while coring device and a coring apparatus within a wellbore, wherein the coring apparatus includes an inner tube configured to receive the core, a pressure sealed plug within the inner tube and a pressure relief valve actuatable to relieve pressure within the inner tube;

lowering the measure while coring device and the coring apparatus to an elevation where the core is to be obtained;

positioning the coring apparatus at the elevation where the core is to be obtained;

starting the coring apparatus thereby causing the core to push the pressure sealed plug through the inner tube increasing pressure within the inner tube until the pressure relief valve actuates;

taking a pressure measurement within the inner tube of the coring apparatus during coring operations; and transmitting the pressure measurement to an operator at a surface elevation.

11. The method according to claim 10, wherein the taking the pressure measurement within the inner tube of the coring apparatus during coring operations is with a measurement while drilling device within the coring apparatus.

12. The method according to claim 10, wherein the pressure measurement is made within the inner tube and above the core at an entry point within the center of a flow diverter.

13. The method according to claim 10, further comprising:

analyzing the pressure measurement at the surface elevation.

14. The method according to claim 10, wherein the measure while coring device is connected to the coring apparatus and is configured to be separately retrievable from the wellbore from the coring apparatus.

15. The method according to claim 10, wherein the pressure relief valve includes a spring pressing a ball into a ball seat, thereby selectively closing the pressure relief valve up to a preset pressure limit within the inner tube.

16. A method for recovering a core from a downhole environment, comprising:

providing a measurements while drilling device and a coring apparatus within a wellbore, wherein the coring apparatus includes an inner tube configured to receive the core, a pressure sealed plug within the inner tube and a pressure relief valve actuatable to relieve pressure within the inner tube;

lowering the measurements while drilling device and the coring apparatus to an elevation where the core is to be obtained;

positioning the coring apparatus at the elevation where the core is to be obtained;

starting the coring apparatus thereby causing core to push pressure sealed plug through the inner tube increasing pressure within the inner tube und the pressure relief valve actuates;

conducting coring operations; and taking at least one measurement in the inner tube of the coring apparatus during the coring operations.

17. The method according to claim 16, wherein the measurements while drilling device is separately retrievable from the wellbore from the coring apparatus.

18. The method according to claim 16, wherein the pressure relief valve includes a spring pressing a ball into a ball seat, thereby selectively closing the pressure relief valve up to a preset pressure limit within the inner tube.

* * * * *